United States Patent [19]

Rausér et al.

[11] Patent Number: 4,511,078

[45] Date of Patent: Apr. 16, 1985

[54] PACKING CONTAINER WITH A CRACK-RESISTANT LAMINATE

[75] Inventors: Jan A. I. Rausér, Lomma; Renato Cetrelli, Lund, both of Sweden

[73] Assignee: Tetra Pak International AB, Lund, Sweden

[21] Appl. No.: 459,682

[22] Filed: Jan. 20, 1983

Related U.S. Application Data

[62] Division of Ser. No. 923,103, Jul. 10, 1978.

[30] Foreign Application Priority Data

Jul. 11, 1977 [SE] Sweden ..... 7708027

[51] Int. Cl.[3] ..... B65D 5/42

[52] U.S. Cl. ..... 229/17 R; 229/48 R; 229/48 T; 229/DIG. 4

[58] Field of Search ..... 229/48 T, 48 R, 48 SC, 229/DIG. 2, DIG. 4, 17 R; 383/903

[56] References Cited

U.S. PATENT DOCUMENTS

| | | | |
|---|---|---|---|
| 1,299,824 | 4/1919 | Cullen | 229/DIG. 2 |
| 2,291,542 | 7/1942 | Filler | 229/DIG. 4 |
| 2,634,046 | 4/1953 | Weber | 229/DIG. 4 |
| 3,032,251 | 5/1962 | Jarund | 229/48 T |

FOREIGN PATENT DOCUMENTS

| | | |
|---|---|---|
| 6501771 | 8/1965 | Netherlands . |

*Primary Examiner*—William Price
*Assistant Examiner*—Gary E. Elkins
*Attorney, Agent, or Firm*—Burns, Doane, Swecker & Mathis

[57] ABSTRACT

A method for forming a packing laminate and a packing laminate are disclosed. The disclosed method provides crack-resistant packing laminates which can be folded during the preparation of packing containers without the formation of excessive cracking due to tensile stresses. Tensile stresses within the folded laminated layers are reduced by either cutting portions of the laminate in an area corresponding to the fold line, or removing portions of the laminate corresponding to the fold line.

5 Claims, 8 Drawing Figures

Fig. 4
PRIOR ART
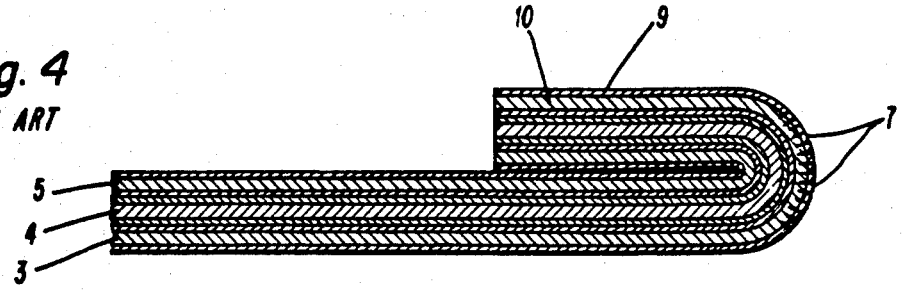
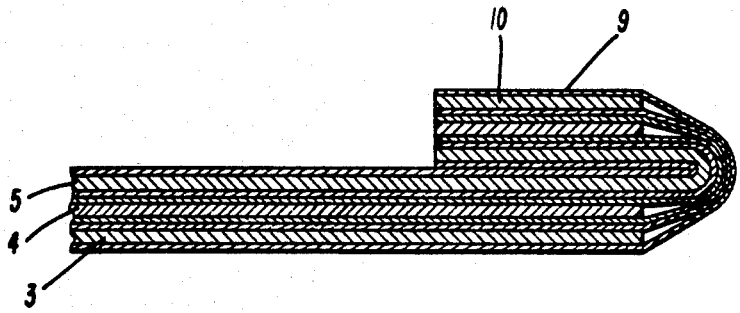
Fig. 5
Fig. 6
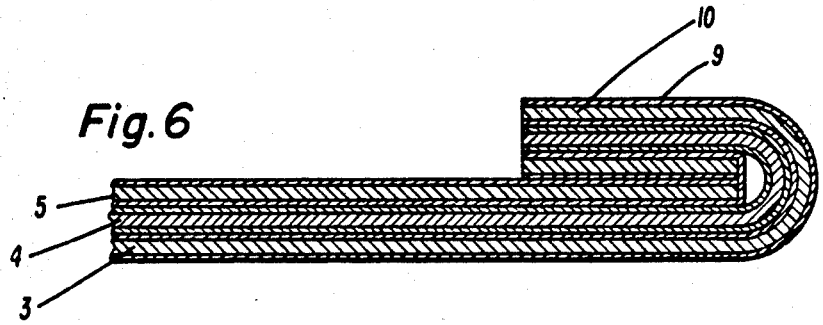
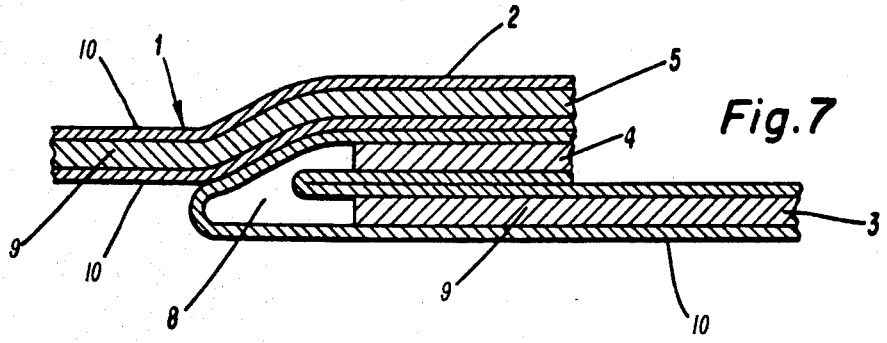
Fig. 7
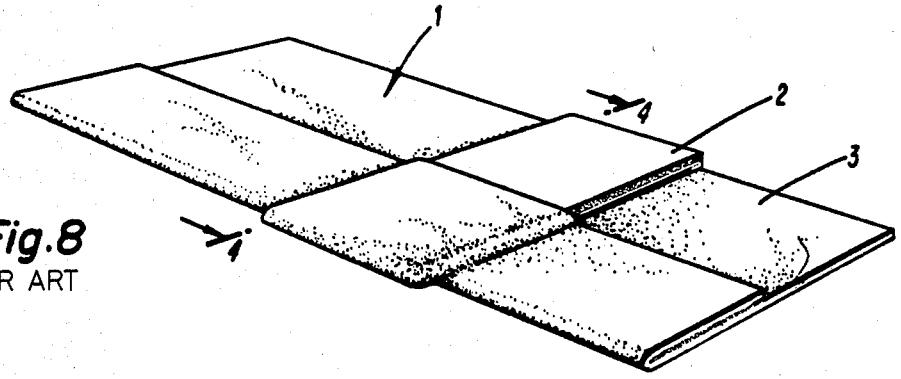
Fig. 8
PRIOR ART

PACKING CONTAINER WITH A CRACK-RESISTANT LAMINATE

This application is a division of application Ser. No. 923,103, filed 7-10-78.

The present invention relates to a method for the design of a packing laminate with the purpose of preventing crack formation in the outer layer of the laminate when several layers of laminate are folded at the same time during the transforming of the laminate to packing containers.

The invention also relates to a laminated material manufactured according to the method comprising a carrier layer and homogeneous plastic layers covering the carrier layer.

Packing containers of the one-way type are frequently manufactured wherein a material in the form of a web or sheet is converted by folding and sealing to a packing container of the desired shape. For this purpose a laminated material may be used which comprises different material layers which give the combined laminate the desired properties when rigidity, strength and imperviousness to liquids are needed. A frequently used packing laminate comprises a centrally located, relatively thick carrier layer of fibrous material, which layer is covered on either side with homogeneous plastic layers. The plastic layers are formed of thermoplastic material, which makes possible a simple sealing of the material by heating and pressing together of the plastic layers of the two parts of material which are to be joined together.

To reduce the light transmission of the packing laminate, the laminate often comprises further layers, e.g. a layer of aluminum foil located between the carrier layer and one of the thermoplastic layers which in the finished packing container very effectively protects the packed contents from the effect of light.

During the forming of the packing container the laminated material is subjected to great stresses. This is especially the case on folding of the material, since a folding of the material means that one of the thermoplastic layers is subjected to a strong stretching owing to the relatively great rigidity of the carrier layer, while the opposite thermoplastic layer is compressed along the whole folding line. Owing to the great extensibility of the thermoplastic layer, however, this only rarely results in the thermoplastics layer being damaged or losing its imperviousness to liquids. The situation is aggravated however if the packing laminate also comprises an aluminium foil, which, compared with the thermoplastic layer, possesses low extensibility and consequently tends to crack when the laminate is folded.

Even if a single folding of a packing laminate of the type described about 180° normally may not have any serious consequences with regard to the imperviousness to liquids and the light transmission of the material, great difficulties arise however when two such folding lines cross one another. This is often the case along the seal or seals which are always found on the packing containers. The seals are usually realized in that the thermoplastic layer which faces towards the inside of the packing container is heated along the edge regions of the packing laminate which are to be joined together, whereupon the two layer areas heated to softening are combined and pressed together so that a sealing fin is produced, which fin is located on the outside of the packing container and comprises two laminate layers. The sealing fin, in order to not form an obstacle, is often folded down against the outside of the packing container, which means that the one laminate layer experiences a 180° folding and that the packing container wall in the actual sealing area consists of three laminate layers, i.e. has threefold thickness.

A seal of the aforementioned type often runs along one or more of the side faces of the packing container, and since these side faces, e.g. during the forming of parallelepipedic packages from cushionlike packages, are subjected to a folding about 180° along a folding line which runs at an angle of 90° to the seal (described in more details in the following), the material thickness will in certain limited areas of the packing container go up to 6 times the laminate thickness. In this folding 180° transversely to the sealing region the material layer which, after the folding, is located on the outside of the fold (that is to say, the material layers located outside the neutral plane created) will be subjected to very strong tensile stress with accompanying stretching and crack formation. These tensile stresses are so great that not only any aluminum layer that may have been incorporated in the laminate, but also the thermoplastic layer, cracks with consequent leakages occuring.

It is an object of the present invention to provide a method for the design of a packing laminate so that the foldings of the packing laminate described above can be carried out without any risk of crack formation and leakage.

It is a further object of the present invention to provide a method for making possible the folding of several layers of packing laminate comprising layers of aluminum foil or other little extensible material without any risk of crack formation along the folding lines in the outer layers.

These and other objects have been achieved in accordance with the invention by a method of the type described characterized in that the carrier layer of the laminate, prior to the application of the remaining layers of the laminate is cut through in one or more of the laminate layers which are subjected to the subsequent folding.

A further preferred embodiment of the method in accordance with the invention is that the carrier layer is provided with an annular cutting around the area where the folding lines converge or cross one another, whereupon the carrier layer material in the cut-out area is removed. This method has proved extraordinarily effective in the critical areas where two 180° foldings cross one another.

A further preferred embodiment of the method in accordance with the invention is that the cutting is in the form of two or more crossing lines, the point of intersection of which coincides with the point of intersection of two or more crossing folding lines. This embodiment of the method substantially brings about the same advantages as the embodiment described previously, according to which part of the carrier layer is cut out and removed, but is in most cases simpler to realize.

A further preferred embodiment of the method in accordance with the invention is that the cutting is carried out in the carrier layer which, after folding and forming of the packing container is located on the outside of the fold.

A further preferred embodiment of the method in accordance with the invention is that the cutting is carried out in the carrier layer which on folding of the laminate is subjected to tensile stresses.

A further preferred embodiment of the method in accordance with the invention is that the cutting is carried out in the carrier layer which after folding and forming of the packing container is located on the inside of the fold.

The invention also relates to a packing laminate manufactured according to the above-described method, which in accordance with the invention is charaterized in that the carrier layer at the places where the packing laminate has converging or crossing folding lines is provided with perforated portions.

A preferred embodiment of the packing laminate in accordance with the invention is that the carrier layer, at the places where the packing laminate has converging or crossing folding lines, is removed in the meeting point of the folding lines.

A preferred embodiment of the method and the arrangement in accordance with the invention will now be described in detail with reference to the enclosed schematic drawing figures, which illustrate the known method of sealing and folding the packing container laminate in the manufacture of packing containers, and the method in accordance with the invention and how the same is applied to these known types of sealing and folding.

FIG. 4 shows on a larger scale a section in longitudinal direction of a prior art sealing fin depicted in FIG. 8.

FIG. 5 shows on enlarged scale a section in longitudinal direction of a sealing fin similar to the fin shown in FIG. 8 which has been modified according to the present invention.

FIG. 6 shows on an enlarged scale a section in a longitudinal direction of the sealing fin, a part of the material having been removed in accordance with a further embodiment of the method in accordance with the invention.

FIG. 7 shows a section in longitudinal direction of the packing container wall and sealing fin in FIG. 1 which has been modified in accordance with the present invention.

FIG. 8 shows a portion of a packing container wall which corresponds to the portion shown in FIG. 2 but which has been shown to be folded a full 180° along a folding line which extends at a right angle to the longitudinal axis of the sealing fin.

The packing laminate shown on the drawings is of a known type and comprises a relatively thick central carrier layer of e.g. paper, which layer gives the material the desired rigidity. In order to prevent the fibrous carrier layer from absorbing moisture from the environment and from the packed contents, the carrier layer has been provided on both sides with thin layers of a homogeneous plastic layer, which is preferably of the thermoplastic type. Depending on the type of contents which are to be packed in the container manufactured from the packing laminate, the packing laminate may also comprise further layers to accomplish different objectives, e.g. an aluminum layer impervious to light which prevents daylight from reaching and acting upon the contents. Further layers with special purposes are also conceivable. Even though the type of laminate described is well known to those versed in the art, the different layers have been marked in the laminate shown on the drawings. In the various Figs. which depict cross-sectional views of the laminate, a carrier layer 10 is depicted to be located between two outer plastic layers 9.

Figure 1:
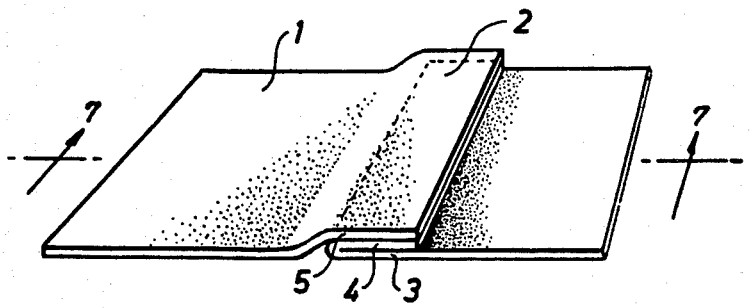
FIG. 1 shows schematically a part of a packing container wall with a sealing fin, which has been folded down to lie against the outside of the packing container laminate.

FIG. 1 depicts a portion of a packing container wall 1 with a seal of the type material-inside to material-inside. This seal is achieved in that the thermoplastic layers of the material facing towards the inside of the packing container are heated along the edge regions which are to be combined, whereupon the layers are pressed against one another so that a seal is achieved with formation of a sealing fin 2 situated outside the package. In order to prevent the sealing fin 2 from being an obstacle and getting caught in neighboring packages etc., it is then folded so as to lie against the outside of the packing container. Consequently the packing container is given in the sealing region threefold wall thickness and comprises more particularly an inner material layer 3 which constitutes the actual packing material wall in the sealing region, together with two material layers 4 and 5 forming the sealing fin 2. The material layer 4 constitutes a part of the material layer 3 folded over about 180°, and the material layer 5 constitutes a continuation of the outer one of the two wall portions sealed together in the sealing fin.

The above described type of sealing is customary and occurs in a great number of packing containers of the one-way type. In a known one-way package, which is used e.g. for liquid dairy products and which is made by the conversion of a material web to a tube provided with a longitudinal joint which is filled with the contents and sealed off by means of transverse seals located at equal intervals, this type of sealing is used. These packages, which after filling and sealing obtain an almost cushion-like shape, are then transformed with the help of forming jaws to substantially parallelepipedic shape, whereby inter alia, the corners of the cushion are pressed flat and folded in to be sealed against the sides of the packing container. This means that the sides on which the sealing fins are situated are folded about 180° along a folding line which is situated at right angle to the sealing fin.

Figure 2:
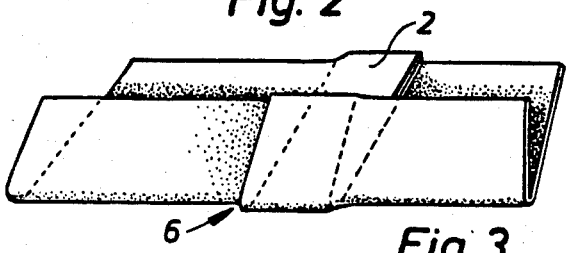
FIG. 2 shows a portion of a packing container wall which corresponds to the portion shown in FIG. 1, which, however, has been folded about 180° (somewhat less for the sake of clarity) along a folding line which extends at a right angle to the longitudinal axis of the sealing fin.

This is illustrated in FIG. 2, where the sealing fin, as in FIG. 1, is indicated by reference numeral 2, while the point at which the two 180° foldings cross one another is indicated by reference numeral 6. At this point a folding as shown in FIG. 8 about 180° takes place of the sealing fin 2 consisting of three laminate layers, which results in a sixfold material thickness, as can be seen from FIG. 4, which shows a longitudinal section through the sealing fin 2 after completion of the folding shown in FIG. 8. The different material layers are indicated by the same reference numerals as in FIG. 1, that is to say 3, 4 and 5. However, the carrier layer of the laminate shown in FIG. 4 has not been modified according to the method of the present invention and is thus representative of the prior art. On folding about 180° of this threefold material, the neutral plane, that is to say the plane in which neither tensile nor compression stresses occur, comes to lie substantially between the inside material layers 4 and 5. In other words, the material layer 5 situated inside the neutral plane will be pressed together at the place of folding and compressed while the two material layers 3 and 4 situated outside the neutral plane will be subjectd to tensile stresses, which are considerably higher in the material layer 3 which is located outermost. The tensile stresses give rise to crack formation in the carrier layer of the material layer 3, which is indicated by reference numeral 7, and frequently also to crack formation in the carrier layer of the material layer 4 located inside. This crack formation, however, is of minor importance. Owing to the large tensile stresses in the material layer 3 located outermost, though, crack formation frequently occurs also in the thermoplastic material layer of this laminate, which has a detrimental effect on the imperviousness of the packing container. When the packing container laminate is of the type which comprises layers of aluminum foil, the double folding of the laminate described unfailingly gives rise to crack formation in the aluminum foil, which crack formation frequently occurs in the two outer material layers 3 and 4.

To avoid these disadvantages it has been attempted hitherto to increase the elasticity of the materials used to the greatest possible extents, which produced quite good results with regard to the thermoplastic layers, while no solution has been found up to now which would prevent crack formation in the aluminum foil.

Figure 3:
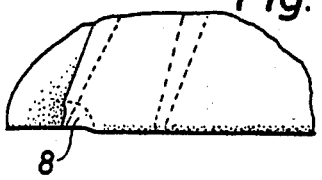
FIG. 3 shows the sealing and folding area according to FIG. 2 and illustrates how a part of the material has been removed in accordance with the method according to the invention.

Earlier attempts at eliminating crack formation were all aimed at increasing the capacity of the material to withstand the stresses occurring. This is not the case in the present invention, which instead endeavours to reduce the stresses, so that, while retaining the laminated material which has proved best from other points of view, the necessary foldings about 180° can be carried out without the layers included in the laminate material being damaged. In accordance with the present invention the tensile stresses are reduced in the outer layers 3 and 4 through bringing them closer to the neutral plane where the stresses are smaller, and more particularly this is done according to an embodiment of the invention wherein the carrier layers of the material layers 3 and 4 (which of course are attached to one another, see FIG. 1) are cut out and are preferably also removed in the area where the two foldings about 180° cross one another. The location of this cutoff portion of material is shown in FIGS. 3 and 7, where the area in which the two material layers 3 and 4 lack a carrier layer is indicated by reference numeral 8. As is evident from FIG. 5, which corresponds to FIG. 4 but shows the folding of a packing laminate modified in accordance with the present invention, the thermoplastic layer in the two material layers 3 and 4, after the removal of the carrier layer in the outermost material layers, can now follow in the actual place of the folding a line which in the actual folding almost coincides with the neutral plane, which means that the thermoplastic layers (and also any aluminum layers present) are practically fully relieved of tensile stresses, so that the imperviousness of the packing material and the capacity to exclude light are retained. This limited area 8, wherein the carrier layer of the material has been removed, is located just at the point of intersection between the two 180° foldings, which means that the weakening caused in the material will be wholly unimportant and negligible. FIG. 7 depicts a cross-sectional view of the laminate of FIG. 1 which has been modified by removal of the carrier layer in the area 8 corresponding to the point 6 (FIG. 2) where the two 180° folds cross one another.

According to a further embodiment of the method in accordance with the invention the tensile stresses on the outer material layers are reduced instead whereby the carrier layer is cut through in the area 8 (FIG. 3) in the innermost material layer 5 which is located inside the neutral plane (FIG. 6). Through this measure this material layer 5, which now only consists of the thermoplastic layers and possibly aluminum foils, will be pressed together more easily and "give way" at the folding, which means that the outer laminate layers 3, 4 can follow a line which more or less coincides with the neutral plane and quite simply "permits a shorter travel" around the folding line. This method thus gives the same effect as the embodiment described earlier, but is to be preferred in certain cases, since the measure will be completely invisible on the finished packing container.

The removal of one or more carrier layers from the laminate layer within the said area takes place during the manufacture of the laminated material, that is to say before the carrier layer is provided with the two thermoplastic layers and possibly any aluminum layers. The carrier layer is preferably removed by punching out the excess material, so that a hole results which simply and with great accuracy can be placed in the right position, since the creases or folding lines along which the material is to be folded during the forming of the packing container clearly mark the place at which the folding lines will cross one another in the finished packing container.

The embodiment described, according to which a part of the carrier layer material is removed, very effectively prevents a crack formation in the remaining layers. However, it is a disadvantage that the portion of material punched out constitutes material wastage which has to be removed and handled, which may cause difficulties at the very high speeds which occur in the material manufacture. To avoid this material wastage, a further embodiment of the invention is also suggested, according to which as an alternative to cutting off and removing a part of the carrier layer, the carrier layer is provided with a cutting in the form of two or more crossing lines, the point of intersection of which coincides with the point of intersection of two or more crossing folding lines. This method gives the carrier layer greater flexibility at the place of folding and reduces the stresses in the thermoplastic and aluminum layers. The method is not as effective, however, as the embodiment described earlier but can nevertheless be used advantageously in cases where the laminate is relatively thin and the stresses are not too great. As in the embodiment where part of the carrier layer material is punched out, the cutting takes place within the area 8 (FIG. 3) in the material portion which forms the two material layers 3 and 4 or in the laminate layer 5. The cutting of the carrier layer is appropriately carried out in this embodiment too before the lamination of the material with thermoplastic or aluminum foil.

A packing laminate in accordance with the invention comprises a carrier layer together with homogeneous plastic layers covering the carrier layer and possibly also further layers e.g. aluminum foil. The packing laminate may be of an arbitrary, known shape, but is provided in accordance with the invention with perforated portions of the carrier layer at the places where the packing laminate has converging or crossing folding lines.

A preferred form of the packing laminate in accordance with the invention results if the carrier layer at the place where the packing laminate has converging or crossing folding lines is removed at the meeting point of the folding lines.

In accordance with the invention a method and a packing laminate are provided wherein the problems existing up to now in foldings about 180° crossing or converging with one another have been effectively eliminated. The method is simple, inexpensive and allows economies, since the material quality can be lowered and adapted to the appreciably smaller stresses which arises in the remaining part of the surface of the packing container.

We claim:

1. A packing container formed from a packing laminate of the type having a carrier layer and at least an outer layer laminated to each side surface of the carrier layer, the container including a wall portion having two portions of said laminate joined together to form a sealing fin, a first fold line along which the sealing fin is folded down against one of said portions of said laminate, a second fold line extending transversely across said first fold line, said sealing fin being folded against itself along the second fold line, an opening being provided in a portion of the carrier layer at a predetermined location only in the carrier layer of one of the portions of said laminate, said location coinciding with and including an area completely encompassing the point where said first and second fold lines intersect, said opening being provided before said carrier layer and said outer layers are laminated, and subsequently joining said laminate to form the sealing fin, folding along said first fold line and folding along said second fold line.

2. The packing container of claim 1, wherein said opening in the carrier layer comprises a portion of the carrier layer which portion is completely removed prior to the formation of said laminate.

3. The packing container of claim 1, wherein the opening is provided in the carrier layer in the portion of the laminate comprising the outermost layer of the wall portion in the completed container.

4. The packing container of claim 1, wherein the opening is provided in the carrier layer in the portion of the laminate comprising the innermost layer of the wall portion in the completed container.

5. The packing container of claim 1, wherein the packing laminate includes a metal foil layer interposed between one of the outer layers and the carrier layer.

* * * * *